United States Patent [19]

Jeter

[11] Patent Number: 4,817,739

[45] Date of Patent: Apr. 4, 1989

[54] DRILLING ENHANCEMENT TOOL

[76] Inventor: John D. Jeter, 1403 Teche Dr., St. Martinville, La. 70582

[21] Appl. No.: 53,357

[22] Filed: May 19, 1987

Related U.S. Application Data

[63] Continuation of Ser. No. 877,216, Jun. 23, 1986, abandoned.

[51] Int. Cl.[4] ..... E21B 21/10

[52] U.S. Cl. ..... 175/38; 175/232; 175/317; 175/324

[58] Field of Search ..... 175/40, 25, 38, 48, 175/317, 318, 324, 232; 367/83, 85

[56] References Cited

U.S. PATENT DOCUMENTS

| | | | |
|---|---|---|---|
| 2,765,146 | 10/1956 | Williams, Jr. | 175/324 X |
| 2,958,511 | 11/1960 | Pfefferle | 175/40 |
| 3,958,217 | 5/1976 | Spinner | 367/83 |
| 4,072,166 | 2/1978 | Tiraspolsky et al. | 175/318 X |
| 4,436,166 | 3/1984 | Hayatdavoudi et al. | 175/324 X |
| 4,519,574 | 5/1985 | Roper | 367/85 X |
| 4,540,055 | 9/1985 | Drummond et al. | 175/323 |
| 4,583,603 | 4/1986 | Dorleans et al. | 175/324 |
| 4,615,399 | 10/1986 | Schoeffler | 175/317 X |

*Primary Examiner*—Hoang C. Dang
*Attorney, Agent, or Firm*—John D. Jeter

[57] ABSTRACT

A drilling fluid pulse generator for use above a drill bit to produce pulsations in drilling fluid flow. An autocycling valve briefly interrupts the flow of fluid to bit jets to reduce the effective hydrostatic pressure at the drilling face and to hydraulic energy in the drill string to thoroughly scour the hole face when the briefly closed valve reopens. An alternate configuration provides a bypass route for fluid diverted from the bit, and the bypass includes jet nozzles to add energy to the return fluid stream to further reduce the effective hydrostatic pressure at the drilling face.

13 Claims, 3 Drawing Sheets

DRILLING ENHANCEMENT TOOL

This application is a continuation of application Ser. No. 877,216 filed June 23, 1986, now abandoned.

Apparatus of this invention pertains to drilling enhancement by producing pulsations in the flow rate of drilling fluid pumped downhole through a drill string bore and ejected at a drill head on the lower end of a drill string.

RELATED ART

Existing United States patents related to pulser valves are U.S. Pat. No. 3,065,416 issued November, 1962, U.S. Pat. No. 3,756,076 issued September, 1973, and U.S. Pat. No. 3,958,217 issued May, 1976. Bottom hole pressure manipulation apparatus are taught by U.S. Pat. Nos. 3,566,980 issued March, 1971; 3,599,732 issued August, 1971, and 3,743,035 issued July, 1973. There are no known cases of fluid pulse generators being used for drilling rate enhancement.

BACKGROUND OF THE INVENTION

Drilling fluids used in wells being drilled serve many purposes. The hydrostatic pressure produced by the column of drilling fluid helps contain downhole pressures produced when the earth overburden is drilled away to make a hole, or well. The drilling fluid is circulated downhole, usually through the drill string bore, to rise in the well outside the drill string to lift cuttings produced by the drill head, to the earth surface.

Secondary purposes served by the drilling fluid include scavenging of cuttings from the hole face with fluid velocity produced by nozzles in the drill head, or bit. Additionally, drilling fluids reduce formation porosity and even occlude small fractures to reduce the loss of drilling fluids into formations. There are other functions of drilling fluid, including chemicals and lubricants, to enhance drilling and hole wall conditioning.

High velocity fluid jets ejected through bit nozzles very near the hole face have a useless and negative side effect. The velocity energy is converted to static pressure at the hole face.

Total fluid pressure, or effective hydrostatic pressure, at the drilling face includes hydrostatic pressure produced by a column of drilling fluid standing in the well plus that pressure resulting from impingement of drilling fluid ejected from nozzles in the drill head against the drilling face. Fluid pressure at the drilling face is known, in many cases, to reduce drilling penetration rate. Reducing overall hydrostatic head to increase penetration rate invites well blowouts and is seldom an acceptable practice. Reducing fluid jet velocity to reduce the pressure on the hole face sacrifices scouring ability and usually results in cutting regrinding by the bit with a resulting net loss in penetration rate.

Attempts have been made to use upwardly directed fluid jets near the drill head, in addition to the downwardly directed jets in the drill head, to reduce effective hydrostatic pressure on the well drilling face. This has experienced some beneficial effects, but in most drilling situations, there is not enough fluid power downhole to adequately serve all jets.

This invention is directed to the provision of a fluid pulser valve near the bit to give brief reductions of fluid flow to the drill head jets followed by a brief increase in flow to scour the hole face. Brief reduction of jet velocity harmlessly reduces effective hydrostatic pressure at the hole face and benefits penetration. The interval of brief fluid flow reduction stores energy in the fluid supply system due to elasticity of all materials involved, and the subsequent direction of stored hydraulic energy through the opening pulser valve and through the drill head nozzles helps to thoroughly scour the hole face of cuttings.

It is therefore an object of this invention to provide a pulser valve in a drilling fluid system in a drill string, near the drill head, to improve penetration rate.

It is another object of this invention to provide apparatus to direct the principal flow of drilling fluid alternately to drill head fluid channels and to bypass channels.

It is yet another object of this invention to provide apparatus to briefly and periodically impede the flow of drilling fluid through drill head fluid channels and to provide drilling fluid bypass channels upstream of the means to impede flow.

It is still another object of this invention to provide apparatus to generate pulsations in the flow of fluid to drill head fluid channels and to provide a free running pulse generator valve that requires no external controls.

It is still a further object of this invention to provide drilling enhancement fluid flow pulser apparatus that permits back flow of fluid to fill the related drill string bore, with valve equipment that will close in response to high rates of forward flow of drilling fluid.

It is yet another object of this invention to provide means to avoid excessive oscillation amplitude in unstable pulse generating elements of a drilling enhancement drilling fluid flow pulser.

These and other objects, advantages, and features of this invention will be apparent to those skilled in the art from a consideration of this specification, including the attached drawings and appended claims.

SUMMARY OF THE INVENTION

In a drill string section, or sub, to be used above a drill head, a pulser valve is installed in the bore to alternately open and close an orifice to cause drilling fluid directed to the drill head to pulsate between conditions of low flow and full flow. During the low flow phase of the cycle, fluid pressure increases in the drill string; and during the full flow phase, the stored fluid energy is directed through drill head openings. The low flow phase reduces fluid pressure on the hole face to aid drilling. The full flow at increased pressure more thoroughly scours the hole face of cuttings.

Alternate embodiments provide bypass channels through the drill string wall to limit pressure buildup in the drill string, and to further reduce bottom hole pressure when flow to the drill head is briefly reduced. Additionally, a relief valve is provided as a further alternative to stop bypass flow when the pulser opens to admit full fluid flow to the drill head.

An optional free running fluid pressure pulser valve actuator is provided and eliminates the need for downhole instruments and controls to actuate the pulser valve. An optional backflow valve permits flushing of the drill string before pulsation is started.

BRIEF DESCRIPTION OF THE DRAWINGS

In the drawings, wherein like reference characters are used throughout to designate like parts.

DETAILED DESCRIPTION OF DRAWINGS

To more clearly illustrate the points of novelty, common construction features of fabrication and maintenance utility such as threaded joints, seals, and threaded fasteners are omitted from the drawings.

Figure 1A:
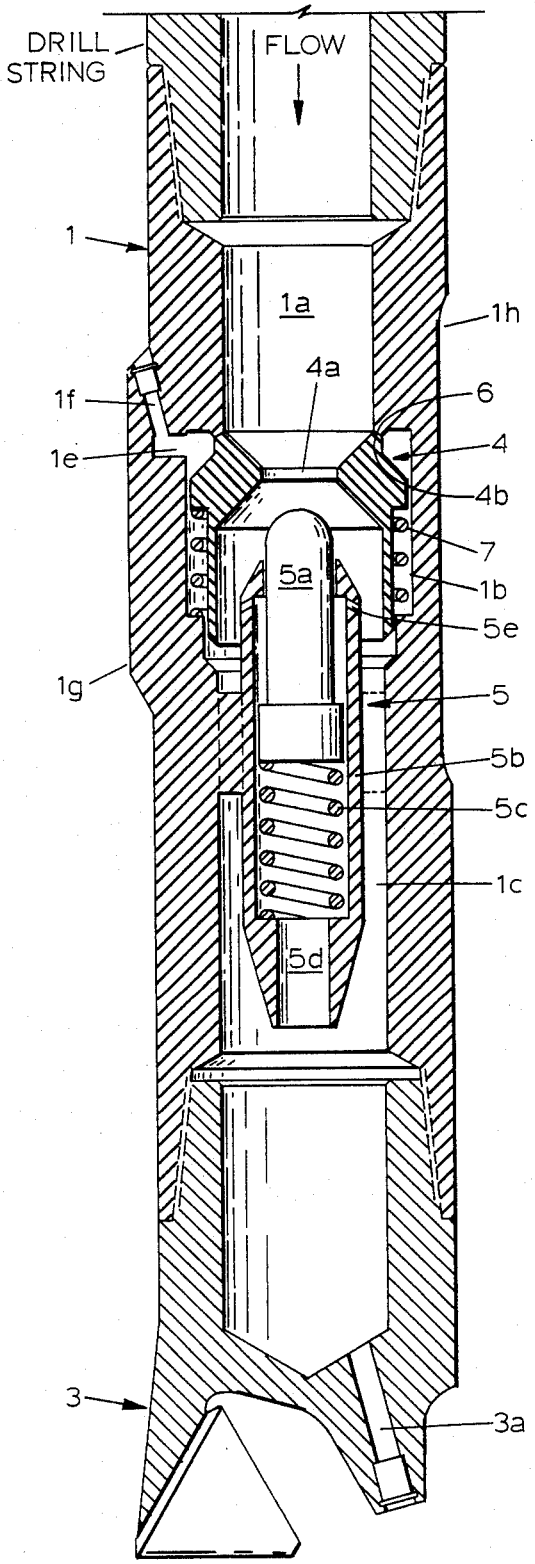
FIGS. 1A and 1B are side views, principally cutaway, of the preferred embodiment of the invention.

In FIG. 1A, body 1 is threadedly attached to the upwardly continuing drill string at the top. Drill head, or bit, 3 is threadedly attached to the body 1 at the lower end. Relief valve 4 is situated for axial motion in body opening 1*b* and is urged upward by spring 7, which bears on a shoulder at the lower end of body opening 1*b*.

Pulser 5 is mounted in body bore 1c such that the pulser poppet 5*a*, when extended from the pulser housing 5*b*, may impede the flow of drilling fluid through orifice 4*a* of relief valve 4. Poppet 5*a* is shown in a downward position. Poppet 5*a* reciprocates axially.

Relief valve 4 has sealing surface 4*b* in engagement with cooperating peripheral seat 6 to close the bypass channel 1*e* leading to upwardly directed nozzles 1*f*. Seat 6 is secured to or is part of the body. Orifice 4*a* and sealing surface 4*b* are part of annular piston 4*c*.

In the conditions shown, drilling fluid flows downward from the drill string bore through body bore 1*a*, through orifice 4*a*, around pulser housing 5*b*, into body opening 1*c*, and to and through bit jet nozzles 3*a*.

Three nozzles 1*f* and three nozzles 3*a* are preferred, distributed about 120 degrees apart about the body central axis; hence, only one of each is seen in the cutaway. Some bits have exit channels but no jet nozzles. The term "nozzles" will be construed herein to apply to bypass and bit or drill head fluid exit channels of any type.

Figure 1B:
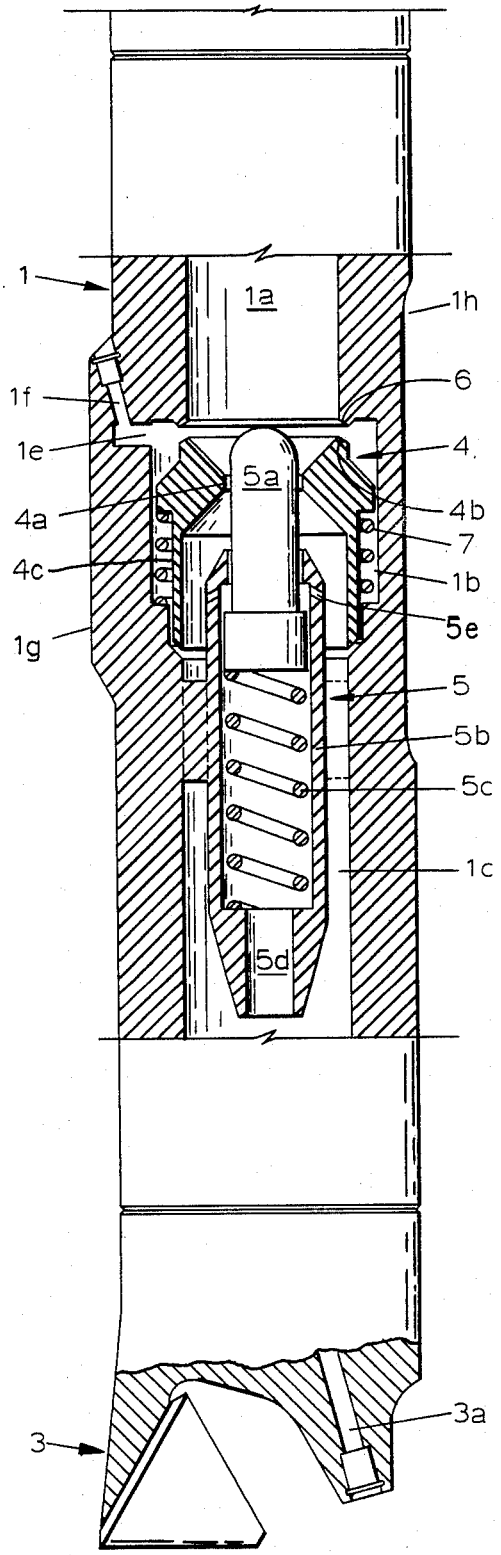

FIG. 1B shows pulser poppet 5*a* in an upward position, practically closing orifice 4*a* and, hence, effectively closing the channels leading to the bit nozzles 3*a*. The pressure differential across the relief valve has moved it downward compressing spring 7 and separating seat faces 4*b* and 6. This opens the bypass channel and admits drilling fluid through channel 1e to nozzles 1*f*.

Pulser 5 is a free running pulser as used in the preferred embodiment of this invention. Any suitable conventional Measurement-While-Drilling (MWD) communication pulser poppet so situated will actuate relief valve 4 to function as previously described herein, and this is anticipated by and is within the scope of the claims. Pulser 5 as shown, however, is in effect a relief valve made unstable by the cooperating action of the relief valve 4. Spring 7 is of such strength that relief valve 4 will not move downward unless orifice 4*a* is essentially closed, to create a pressure differential across the valve 4. Poppet 5*a* has mass and does not instantly reverse direction when it moves upward, and orifice 4a moves downward. Because poppet 5*a* must travel farther downward to open than it did to close, because of the changed location of orifice 4*a*, more hydraulic energy is available to push poppet 5*a* downward than is required to move it upward, and energy is stored in spring 5*c*. This amounts to excess feedback and assures unstable operation. This comprises a free running pulser. The pulser cyclic frequency is influenced by the weight of poppet 5*a* relative to the force produced by spring 5*c*.

Operating cooperatively as described, the combination of poppet 5*a* and its cooperating orifice 4*a* and relief valve 4 comprises a flow channel selector valve. Considering bore 1*a* to be a first fluid channel, bore 1*c* to be a second fluid channel, and by-pass channel 1e to be a third fluid channel, the combination continually cycles to alternately direct fluid to one of the second and third channels from the first channel.

The housing 5*b* is supported by fins extending to and secured to body 1. Spring 5*c* is supported by the bottom of the housing enclosure. Channels 5*d* and 5*e* in the housing 5*b* vents fluid from below and above the enlarged end of the poppet 5*a*.

Preferred cyclic rate is about 120 to 1800 per minute. The ideal cyclic rate depends largely upon formations drilled and bottom hole pressure differentials. FIGS. 1A and 1B represent the preferred embodiment of the invention.

Diametral dimensions available in drill strings for apparatus are usually limited, and external fluid nozzles 1*f* may include jet nozzles. Radial protuberance 1*g* has the form of a stabilizer blade into which a nozzle for channel 1*f* is embedded. To increase eductive coupling of the jet from the nozzle with the drilling fluid moving upward in the well, the upper end of protuberance may be streamlined with some metal removal from the body alongside the stabilizer blade, as shown at 1*h*. Three blades are preferred, and area 1*h* is generally opposite blade 1*g* but adjacent other blades.

Figure 2A:
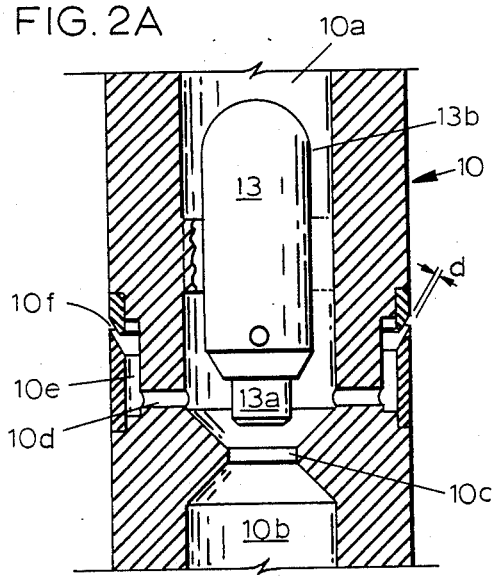
FIGS. 2A and 2B are side views, principally cutaway, of an alternate embodiment of the invention.
Figure 2B:
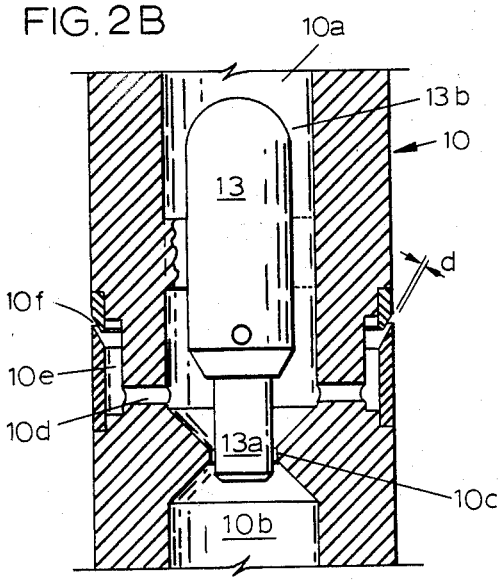

FIGS. 2A and 2B show an alternate embodiment of the apparatus utilizing an inverted pulser made unstable and free running without a cooperating moving orifice. The pulser will be described in detail later. There is no valve controlling the optional bypass channels to the optional upwardly directed nozzles. The body 10 is threadedly attached to an upwardly continuing drill string (not shown). A drill head, or bit, (not shown) is threadedly secured to the lower end of the body.

The relationship of the pulser assembly and the upwardly continuing drill string and the drill head has already been clarified by FIGS. 1A and 1B, and is not repeated for FIGS. 2A and 2B.

Communication (MWD) pulsers, if used instead of free running pulsers, are well established in the drilling industry. Such MWD pulsers are taught by the United States patents previously listed herein, and by reference are made part of this specification. The inverted pulser of FIGS. 2A and 2B, as well as 3A and 3B are disclosed in my copending U.S. patent application Ser. No. 865,083. The communication MWD pulser of that copending application has locks to control pulsing rate and encoding rather than being allowed to run free.

In FIG. 2A fluid moving down the bore of the drill string flows through body opening 10a, around the pulser housing 13*b*, through orifice 10*c*, through body bore 10*b*, and to and through bit jet nozzles. If the optional bypass nozzles are used, part of the drilling fluid flows through channels 10*d* and to and through upwardly directed nozzles. Pulser 13 is secured in the opening 10*a* by fins extending to and attached to the body. Poppet 13*a* can reciprocate axially in housing 13*b*, and can extend to essentially close orifice 10*c*.

An optional peripheral nozzle is shown by FIGS. 2A and 2B. If used, fluid flows through channels 10d into annular plenum 10e, and out through opening 10*f*. Opening 10*f* of width d extends around the outer periphery of body 10. This arrangement conserves radial space. The nozzles 1*f* of FIGS. 1A and 1B can be used if preferred and space permits. The protuberance 1*g* may be used. The annular nozzle also can be used with the bypass valve of FIGS. 1A and 1B.

In FIG. 2B, poppet 13*a* has extended into orifice 10*c* and essentially stopped fluid flow to the drill head. If bypass nozzles are used, they are preferred to be substantially smaller than the bit nozzles. When the orifice is closed, the drilling fluid pressure above the orifice will increase. The stored hydraulic energy in the reasonably capacitive long drill string and associated plumbing will deliver a pulse of hydraulic energy to the bit nozzles, when orifice 10c is opened. The orifice 10*c* and poppet 13*a* comprise a restrictor valve. Pulser valves conventionally have interfering seat surfaces on orifice and poppet, and if conventional signal pulsers are used, (and they can be) the interference seats are appropriate. A free running pulser, however, performs best if the poppet energy is not wasted on seat impact. Poppet 13*a* can extend through orifice 10*c*.

Figure 3A:
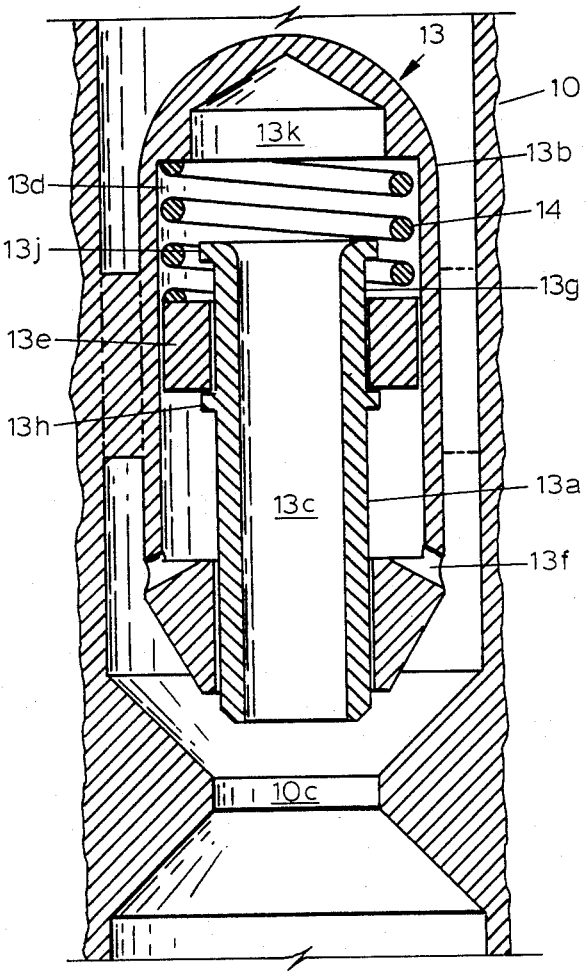
FIGS. 3A and 3B are side views, principally cutaway, of a free running pulser valve capable of operating without external controls.
Figure 3B:
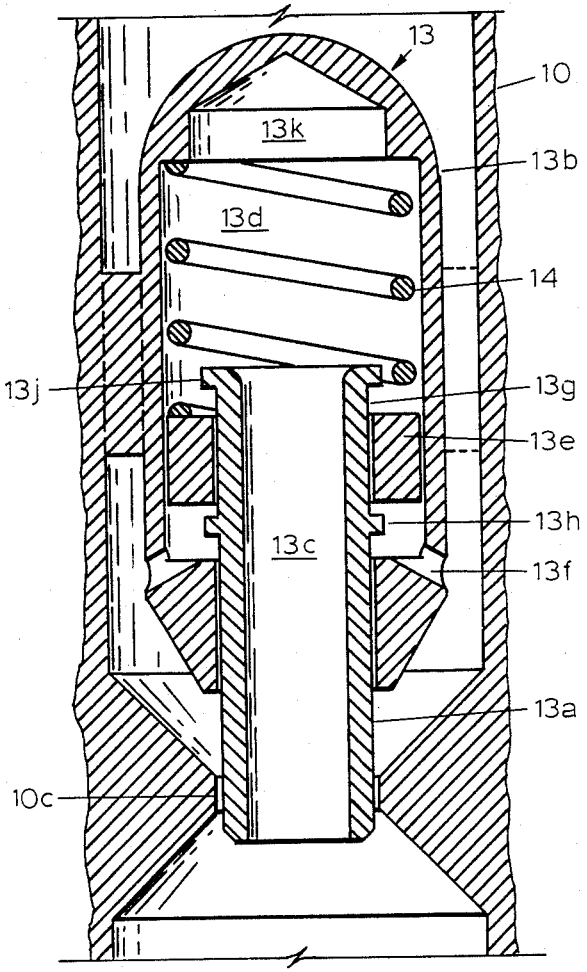

FIGS. 3A and 3B show details of the free running pulser of FIGS. 2A and 2B.

Piston 13*e* is situated to move axially in bore 13*d*. Poppet 13*a* can move axially relative to housing 13*b* and can move a limited amount axially relative to piston 13*e*. Compression spring 14 bears on the housing and on piston 13e.

With no fluid flow, the poppet will be fully extended, into orifice 10*c*. When fluid flow begins, fluid pressure differential across the orifice will increase. The pressure below the orifice will be conducted through bore 13*c* into housing bore 13*d*. Pressure above the orifice will be conducted through ports 13*f*. The pressure differential will not directly move the poppet, because it has the same area on both ends, and effective piston areas are exposed only to pressure that exists below the orifice. The pressure differential will, however, act on piston 13*e* and move it upward, compressing spring 14. The limited free travel relative to poppet 13*a* is established by the two spaced shoulders 13*h* and 13*j*. Piston 13*e* eventually lifts poppet 13*a* clear of the orifice. A steady increase in fluid flow would steadily lift the poppet, but the first upsetting change such as a drill string axial motion or flow pulsation, and the piston and poppet will cease to be stable.

In FIG. 3A, the piston 13*e* has started down after lifting poppet 13*a* to the upper travel limit. Downward acceleration of piston 13*e* holds the piston on shoulder 13*h* until piston 13*e* is decelerated by the developing pressure drop across the orifice when the poppet begins flow interference. Downward movement of poppet 13*a* will be continued by inertia until shoulder 13*j* hits the top of the piston. This produces a pressure drop across the orifice that spring 14 alone could not produce.

In FIG. 3B, piston 13*e* has started upward but is not yet able to lift the poppet. Pressure across the orifice is developing beyond control of the piston and spring, and response linearity is lost. Piston 13*e* is accelerated upward, and hydraulic energy stored upstream of the orifice will carry the piston above that position it would have reached with the orifice open in absence of the lost motion arrangement. Oscillation will proceed because the piston is continually moving to correct response error.

The piston will move in response to pressure change across the orifice, but the lost motion between piston and poppet violates the linearity and causes a misphase between poppet position and the pressure differential that moves piston 13*e*. The pulses grow suddenly in amplitude. The frequency and amplitude of pressure pulses are influenced by the strength of spring 14 and the sum of moving weights. The ratio of poppet and piston weight influences the level of disturbance needed to start oscillation. The amount of free motion between the piston and poppet has an impressive effect upon all operating parameters, especially pulse amplitude. Once in motion, the pulser is self exciting as long as fluid flow continues.

The pulser of FIGS. 3A and 3B can be used with the movable orifice and relief valve of FIGS. 1A and 1B. This use does, however, require more free motion between poppet 13*a* and piston 13*e*.

Conventional relief valve design associated with reasonably elastic upstream hydraulic systems have been oriented to the prevention of unstable operation known as chattering. Drill strings are considered quite rigid, but thousands of feet of drill string upstream of a mainstream relief valve can cause chatter. Relief valves are not commonly designed to chatter, and the usual procedure is to redesign a chattering valve to make it stable in operation, to prevent pulsations in fluid flow. A relief valve may seem quite stable on short coupled drilling hydraulic systems subjected to surface tests, yet chatter when the full drill string is assembled. The resulting pulsations are usually of a frequency that does not survive the trip through a long drill string to be detected on surface pressure sensors. The chattering is usually detected in wear patterns on damaged but recovered relief valve structure. Remedial redesign usually follows to prevent chattering in conventional use.

There is no readily available body of knowledge to define the design of a relief valve that will chatter. It is general knowledge among design engineers that the area and shape of surfaces swept by high velocity fluid can cause a valve to chatter. The weight of relief valve parts that move with the will usually accept a high pitched squeal from a relief valve as non-destructive. It follows that reversing the general oscillation avoidance practices will produce a chattering valve. The result is often referred to as water hammer.

The pulser valve preferred for this invention should oscillate in short coupled surface tests as well as downhole, and the structure associated with the disclosed pulse generating valves will force instability. A chattering relief valve, however, that will chatter downhole even if unable to do so on short coupled surface tests is anticipated by and is within the scope of the claims.

Such simple pulsation producing valves will be used when confidence in their instability downhole reduces the demand that they demonstrate pulsing action on surface, rig floor, tests.

Downhole motors of the positive displacement type or the turbine type are often used on drill strings to drive drill heads at higher than rotary speeds. Apparatus of this invention can be used with downhole motors. The valving of the apparatus would not work well above a downhole mud driven motor, but should work well with an electrodrill if used above or below the electrodrill. With mud powered motors, the preferred embodiment of FIGS. 1A and 1B should produce little disturbance to the motor, and should accomplish the intended purpose if used below the motor. Such motors are not shown in the drawings, but are considered part of a drill string when used. As drill string components, the use of apparatus of this invention with downhole drilling motors is anticipated by and is within the scope of the claims.

Free running pulser valves designed to run in high density and highly viscous drilling fluids experience increased poppet excursion travel in sea water and other light density fluids. The result can be destructive poppet overtravel. Dash pots could always be used to consume energy and reduce poppet excursion, but if full stroke damping is used, sensitivity to many variables is undesirable.

Figure 4:
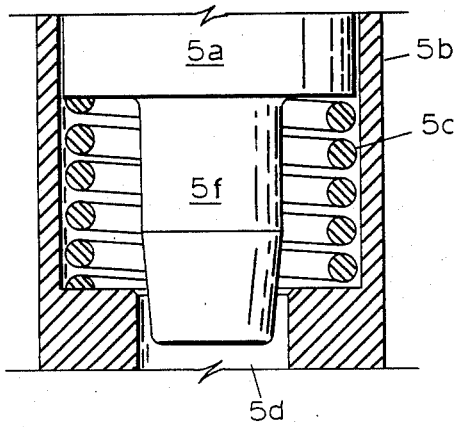
FIG. 4 is a side view, partially cutaway and somewhat enlarged, of a selected area of FIG. 1A with an added feature.
Figure 5:
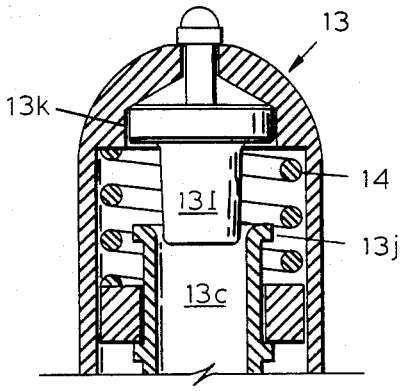
FIG. 5 is a side view, partially cutaway and somewhat reduced in scale, of a selected area of FIG. 3A with an added feature.

The stroke control throttles of FIGS. 4 and 5 are usable on the apparatus of FIGS. 1A–B and 3A–B respectively. In FIG. 4, the throttle plunger 5f is added to the lower end of poppet 5*a*. When excessive stroke occurs, the tapered plunger 5*f* enters bore 5*d* and throttles the movement of fluid through the bore and consumes enough energy to control poppet excursion.

In FIG. 5, throttle 13l is fitted into recess 13*k* and secured by a bolt and acorn nut. At extreme upward poppet overtravel, the tapered end of throttle 13*l* enters bore 13*c* and throttles the movement of fluid through the bore. This throttle arrangement is not parasitic when heavier mud or low flow rates do not cause overtravel.

When a drill string is assembled while being lowered into a well, it conventionally fills with drilling fluid flowing into the drill string bore through drill head fluid nozzles. If there are obstructions in the drill string bore such as positive displacement motors, it is conventional practice to place a sub, containing a check valve, above the obstruction to allow fluids to flow from the well annulus into the drill string bore. The check valve closes when fluid is pumped down the drill string bore, so that drill string fluid will flow through the motor.

Drilling fluids that flow from the well bore into the drill string bore may contain pieces of rubber, gravel, and other large solids. When the pumps are started, the undesirable solids may obstruct closing of check valves and damage motors and other downhole gear. Screens used to prevent entry of larger solids may become plugged. It is preferable to keep check valves open until the first few gallons of fluid is forced downward through the drill string, to expel undesirable solids that entered directly from the well.

Figure 6:
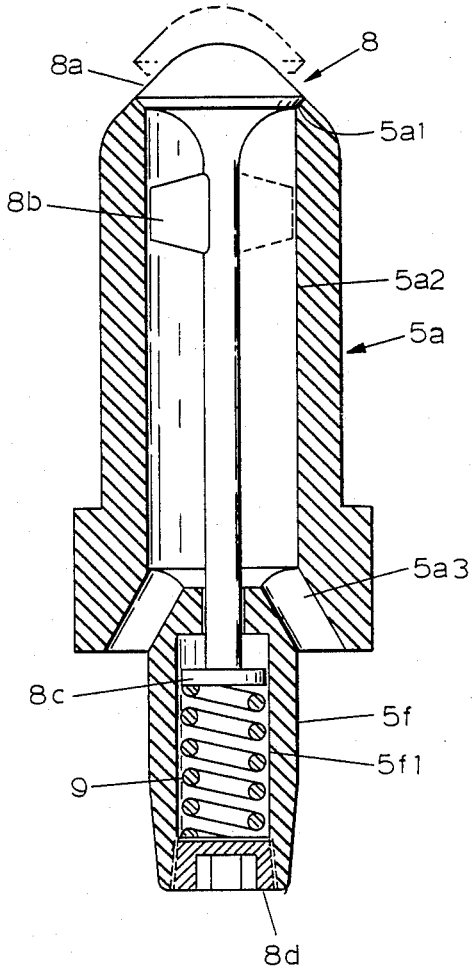
FIG. 6 is a side view, partially cutaway and somewhat enlarged, of a selected area of FIG. 1A with optional modifications.
Figure 7:
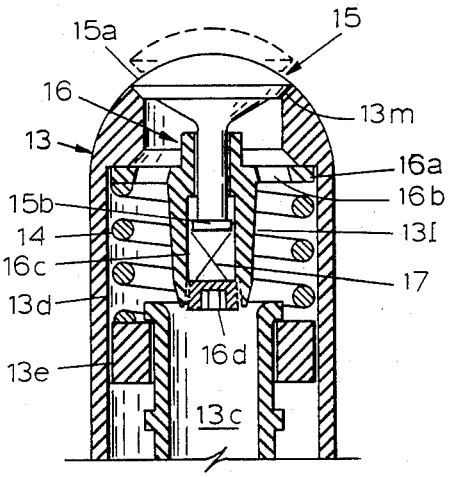
FIG. 7 is a side view, partially cutaway and reduced in scale, of a selected area of FIG. 3A with optional modifications.

The check valve of FIGS. 6 and 7, usable on the apparatus of FIGS. 1A and 1B and on apparatus of FIGS. 3A and 3B, respectively, stay open at low flow rates and close at higher flow rates. The drill string then may be filled by well fluids, but the well fluids may then be expelled at low flow rates pumped down the drill string bore.

FIG. 6 shows a modified poppet of FIG. 1A with the tapered throttle plunger 5*f* of FIG. 4, supplied with a check valve. As shown in FIG. 1B, poppet 5*a* normally closes orifice 4*a*, and upward flow of fluid from well to drill string bore is inhibited. Poppet 5*a* is provided with bore 5*a*2 with valve seat 5*a*1 at the upper end. Channels 5*a*3 allow fluid that enters opening 5*d* of FIG. 1A to flow into bore 5*a*2.

Spring 9 in bore 5*f*1 bears on plug 8*d* and terminal 8*c*, and urges check valve 8 upward to lift valve head 8*a* off seat 5*a*1. Fins 8*b* keep the opened valve centered.

When drilling fluid is slowly pumped down the drill string bore, valve 8 stays open due to the force of spring 9, and a preferred amount of drilling fluid can be circulated to clean up the drill string bore. The clean up accomplished, drilling fluid flow is increased, and the valve head 8*a* is entrained, overcoming spring 9 to close the check valve. The poppet 5*a* then performs as a pulser as previously described.

FIG. 7 shows a modified housing 13*b* of FIG. 3A. Housing 13*b* now has valve seat 13*m* to mate with valve head 15*a* of check valve 15. To support, guide, and control check valve 15, guide 16 is fitted into the top of opening 13*d* and held in place by spring 14 bearing on flange 16*a*. The guide 16 has a throttle 131, explained for FIG. 5. The throttle is bored to slidingly fit valve stem 15*b* and opens to accommodate spring 17 in recess 16*c*. Plug 16*d* terminates the recess. Spring 17 urges valve 15 upward, and fluid can flow through bore 13*c*, through channels 16*b*, and upward into the drill string bore.

As previously explained for FIG. 6, slow downward flow of fluid will not close valve 15 until the flow rate is enough to entrain valve head 15*a* and compress spring 17. The pulser can then carry out the function previously described herein.

The apparatus of FIGS. 1A–B and 2A–B can be caused to function by the use of conventional MWD communication fluid pulse generators. Conventional MWD pulsers have a poppet situated below the cooperating orifice. My copending patent application Ser. No. 865,083 discloses a communication pulser contrived to operate above the cooperating orifice either as a version installed in the drill string or as a version to be lowered through the drill string as a shuttle package.

Conventional MWD pulsers respond to downhole parameter sensors and binary encoders to space pulses in a code to be detected and decoded at the earth surface.

Timers are well established in the art, capable of actuating the pulser without sensors and encoders in a preset cyclic fashion. Apparatus of this invention so related to the modified communication pulser that the pulser poppet cooperates with the disclosed orifice will function as disclosed herein. The advantage of using a fixed rate of pulse generation even as flow and other parameters vary can be appreciated. When the reliability and life of MWD pulsers are improved, their use is planned. Such use of conventional pulsers is anticipated by and is within the scope of the claims.

In applications involving adequate elasticity in the drilling system above the pulser valve, the piston 13*e* can be axially secured to, or be made part of, poppet 13*a* of FIGS. 3A–B. The valve will still auto-cycle as described herein. Current field practice is to require the pulser to function when at the surface in rig floor tests, and the arrangement shown is FIG. 3A–B assures such function in absence of the long drill string.

For definition, as used herein, a fluid flow control valve that continuously cycles between a more open state and a more closed state will be called a "fluid through-flow oscillator".

From the foregoing, it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

The invention having been described, we claim:

1. Apparatus for use downhole on a fluid conducting drill string in a well having a drilling face exposed to an effective hydrostatic pressure produced by a column of drilling fluid in the well and by pressure produced by a drilling fluid stream pumped down the drill string and ejected from a drill head against the drilling face, to improve penetration rate of the drill head by causing pulsations in the velocity of drilling fluid ejected, the apparatus comprising:

(a) a body, generally cylindrical and elongated, having an upstream end adapted for fluid tight attachment to an upwardly continuing portion of said drill string, a downstream end adapted for fluid tight attachment to a downwardly continuing portion of said drill string, and an opening;

(b) fluid communication means situated in said body and comprising; at least one first fluid channel arranged to conduct said drilling fluid stream from said upwardly continuing portion to said opening, and at least one second fluid channel arranged to conduct at least part of said drilling fluid stream from said opening to said downwardly continuing portion;

(c) a drill head, comprising at least part of said downwardly continuing portion, having at least one opening arranged to eject at least part of said drilling fluid stream against said drilling face;

(d) drilling enhancement pulser valve means, situated in said opening and comprising an orifice, said orifice defining an upstream side and a downstream side, situated in said opening, arranged to separate said first fluid channel from said second fluid channel and to accept at least part of said drilling fluid stream therethrough, a poppet situated in said opening on said downstream side, arranged to reciprocate between a first position toward said orifice, corresponding to more flow resistance and a second postion away from said orifice, corresponding to less flow resistance, reciprocation of said poppet to result from resonant motion of the mass of said poppet biased toward said orifice and urged away from said orifice by the force of drilling fluid flowing therethrough;

(e) a spring, situated in said body, arranged to urge said poppet toward said orifice; and (f) actuator in said body for automatically moving said poppet between said first and said second positions in response to and during continuing flow of said drilling fluid stream at a constant flow rate.

2. The apparatus of claim 1 wherein at least one third fluid channel, in said body, is arranged to conduct fluid from said first fluid channel, through the wall of said body, and into the well outside said body, said third fluid channel arranged to deliver fluid into said well in a direction toward said upstream end of said body.

3. The apparatus of claim 2 wherein a fluid pressure relief valve is situated in said body and arranged to inhibit fluid flow through said third channel means until fluid pressure in said first fluid channel exceeds fluid pressure in said well, outside said body, a preselected amount.

4. The apparatus of claim 3 wherein said fluid pressure relief valve comprises: a piston having, an axis, an upstream end and a downstream end, situated in said opening in sealing engagement therewith and arranged to move axially therein in the direction of reciprocation of said poppet, said piston having surfaces distributed about said axis to comprise said orifice; a sealing surface on said piston, and an annular surface on said body between said first fluid channel and said third fluid channel defining a peripheral seat arranged to cooperate with said sealing surface to inhibit fluid flow from said first fluid channel to said third fluid channel, and at least one spring arranged to urge said piston toward said peripheral seat.

5. The apparatus of claim 1 wherein said poppet is adapted to move some distance into said orifice when said poppet is in said second position.

6. The apparatus of claim 1 wherein check valve means is situated in said poppet in fluid communication with said first fluid channel and said second fluid channel and adapted to accept fluid flow from said second fluid channel to said first fluid channel.

7. Apparatus for use downhole in a fluid conducting drill string in a well having a drilling face exposed to an effective hydrostatic pressure produced by a column of drilling fluid in the well and by pressure produced by a drilling fluid stream pumped down the drill string bore and ejected from a drill head against the drilling face, to improve penetration rate of the drill head by causing pulsations in the velocity of fluid ejected, the apparatus comprising:

(a) a body, generally cylindrical and elongated, having an axis, an upstream end arranged for fluid tight attachment to an upwardly continuing portion of said drill string, and a downstream end arranged for fluid tight attachment to a downwardly continuing portion of said drill string;

(b) fluid communication means, in said body, comprising; an opening in said body, at least one first fluid channel arranged to conduct said drilling fluid stream from said upwardly continuing portion to said opening, at least one second fluid channel arranged to conduct at least part of said drilling fluid stream from said opening to said downwardly continuing portion, and at least one third fluid channel arranged to conduct at least part of said drilling fluid stream from said opening, through the wall of said body to the well outside said body;

(c) penetration rate enhancing valve means mounted in said opening, arranged to deliver at least part of said drilling fluid stream from said first fluid channel, alternately, to said second fluid channel and to said third fluid channel to cause said pulsations, said penetration rate enhancing valve means comprising;

an annular piston, having a sealing surface, situated in said opening for reciprocating movement therein, arranged to separate said first and said second fluid channels with opposed piston faces responsive to pressure difference therebetwen to urge said annular piston in the direction of said movement; an annular surface on said body, between said first and said third fluid channels, defining an annular seat arranged to cooperate with said sealing surface to variably resist fluid flow between said first and said third fluid channels; an orifice in said annular piston, opening in said direction and arranged to accept at least part of said drilling fluid stream from said first fluid channel to said second fluid channel; a poppet situated in said opening, arranged to reciprocate in said direction to cooperate with said orifice to variably resist the flow of fluid therethrough; a first spring arranged to urge said poppet toward said orifice and a second spring arranged to urge said annular piston toward said annular seat such that, at a preselected flow rate of said drilling fluid stream, fluid flow will be inhibited between said first and said third fluid channels when said poppet is away from said orifice and, when said poppet inhibits flow through said orifice, said annular piston will move to allow fluid flow from said first to said third fluid channel, reciprocation of said poppet being assured by movement of said orifice in the direction of said poppet when said poppet inhibits flow from said first to said second fluid channel, adding energy to the movement of said poppet away from said orifice; and (d) actuator means in said body for automatically reciprocating said poppet in response to and during continuous flow of said drilling fluid stream at a constant flow rate.

8. The apparatus of claim 7 wherein said third fluid channel is arranged to provide an upwardly directed stream of drilling fluid into said well from at least one nozzle in said drill string.

9. A method for increasing the penetration rate of a drill head on a fluid conducting drill string suspended in a well having a drilling face exposed to an effective hydrostatic pressure comprising hydrostatic pressure produced by a drilling fluid column in the well and pressure resulting from impingement of a stream of drilling fluid ejected from the drill head against the drilling face, the method comprising the steps of:

(a) pumping a drilling fluid stream down the bore of the drill string, through a downhole fluid flow resistance means, and ejecting at least part of said drilling fluid stream, from at least one nozzle in said drill head, against the drilling face;

(b) periodically increasing the resistance of said downhole fluid flow resistance means to reduce the velocity of said drilling fluid stream ejected from said nozzle to reduce the effective hydrostatic pressure and to store fluid pressure energy in said drill string; and (c) periodically reducing said resistance of said downhole fluid flow resistance means to increase said velocity of said drilling fluid stream ejected from said nozzle;

said increasing and said reducing of said resistance being caused to occur alternately and automatically in response to and during constant flow of said drilling fluid stream at a constant flow rate.

10. A method for increasing the penetration rate of a drill head on a fluid conducting drill string suspended in a well having a drilling face exposed to an effective hydrostatic pressure comprising hydrostatic pressure produced by a drilling fluid column in the well and pressure resulting from impingement of a stream of drilling fluid ejected from the drill head against the drilling face, the method comprising the steps of:

(a) pumping a drilling fluid stream down the bore of the drill string and ejecting at least part of said drilling fluid stream, from at least one nozzle in said drill head, against the drilling face; and (b) periodically diverting at least part of said drilling fluid stream to the well, outside the drill string through at least one upwardly directed nozzle in the drill string, to periodically reduce the effective hydrostatic pressure at said drilling face;

said periodically diverting being caused to occur continually and automatically in response to and during constant flow of said drilling fluid stream at a constant flow rate.

11. Apparatus for use downhole in a fluid conducting drill string in a well having a drilling face exposed to an effective hydrostatic pressure produced by a column of drilling fluid in the well and by pressure produced by a drilling fluid stream pumped down the drill string and ejected from a drill head against the drilling face, to improve penetration rate of the drill head by causing pulsations in the velocity of drilling fluid ejected, the apparatus comprising:

(a) a body, generally cylindrical and elongated, having an upstream end adapted fro fluid tight attachment to an upwardly continuing portion of the drill string, a downstream end adapted for fluid tight attachment to a downwardly continuing portion of the drill string, and an opening;

(b) fluid communication means situated in said body and comprising; at least one first fluid channel arranged to conduct said drilling fluid stream from said upwardly continuing portion to said opening, and at least one second fluid channel arranged to conduct at least part of said drilling fluid stream from said opening to said downwardly continuing portion;

(c) a drill head, comprising at least part of said downwardly continuing portion, having at least one opening arranged to eject at least part of said drilling fluid stream against said drilling face;

(d) drilling enhancement pulser valve means, situated in said opening and comprising an orifice, said orifice defining an upstream side and a downstream side, situated in said opening, arranged to separate said first fluid channel from said second fluid channel and to accept at least part of said drilling fluid stream therethrough, a poppet situated in said opening on said upstream side, arranged to reciprocate between a first position toward said orifice, corresponding to more flow resistance and a second position away from said orifice, corresponding to less flow resistance, said reciprocation of said poppet to result from resonant motion of the mass of said poppet biased toward said orifice and urged away from said orifice by the force of said drilling fluid flowing therethrough;

(e) a spring, situated in said body, arranged to urge said poppet toward said orifice;

(f) actuator means in said body for automatically moving said poppet between said first and second positions in response to and during continuing flow of said drilling fluid stream at a constant flow rate, said actuator means comprising a piston arranged for reciprocation in a cooperating cylinder in said body, with opposed piston faces in fluid communication with opposed said upstream and downstream sides, sized and oriented such that pressure in said first fluid channel higher than pressure in said second fluid channel will cause said actuator to urge said poppet toward said second position.

12. The apparatus of claim 11 wherein at least one third fluid channel, in said body, is arranged to conduct fluid from said first fluid channel, through the wall of said body, and into the well outside said body, said third fluid channel arranged to deliver fluid into said well in a direction toward said upstream end of said body.

13. The apparatus of claim 12 wherein a fluid pressure relief valve is situated in said body and arranged to inhibit fluid flow through said third fluid channel until fluid pressure in said first fluid channel exceeds fluid pressure in said well, outside said body, a preselected amount.

* * * * *